US011225406B2

(12) United States Patent
Briant et al.

(10) Patent No.: US 11,225,406 B2
(45) Date of Patent: Jan. 18, 2022

(54) BEVERAGE DISPENSE SYSTEMS AND BEVERAGE COOLERS

(71) Applicant: HEINEKEN UK LIMITED, Central Scotland (GB)

(72) Inventors: Stuart Briant, Central Scotland (GB); Simon Gray, Central Scotland (GB); Guy Hutchinson, Central Scotland (GB); Chris Merrifield, Central Scotland (GB)

(73) Assignee: HEINEKEN UK LIMITED, Central (GB)

( * ) Notice: Subject to any disclaimer, the term of this patent is extended or adjusted under 35 U.S.C. 154(b) by 131 days.

(21) Appl. No.: 15/503,502

(22) PCT Filed: Aug. 10, 2015

(86) PCT No.: PCT/GB2015/052306
§ 371 (c)(1),
(2) Date: Feb. 13, 2017

(87) PCT Pub. No.: WO2016/024097
PCT Pub. Date: Feb. 18, 2016

(65) Prior Publication Data

US 2017/0233238 A1 Aug. 17, 2017

(30) Foreign Application Priority Data

Aug. 14, 2014 (GB) ..... 1414425

(51) Int. Cl.
*B67D 1/08* (2006.01)
*B67D 1/04* (2006.01)
(Continued)

(52) U.S. Cl.
CPC ..... *B67D 1/0884* (2013.01); *B67D 1/0003* (2013.01); *B67D 1/0406* (2013.01);
(Continued)

(58) Field of Classification Search
CPC ..... B67D 1/0884; B67D 2210/00104; B67D 2210/00089; F25B 2700/151
See application file for complete search history.

(56) References Cited

U.S. PATENT DOCUMENTS 4,045,973 A * 9/1977 Anderson ..... F25B 49/02 62/158
4,754,609 A * 7/1988 Black ..... B67D 1/0057 62/200
(Continued)

FOREIGN PATENT DOCUMENTS

CN 103838279 A * 6/2014
EP 1 510 499 A 3/2005
(Continued)

OTHER PUBLICATIONS

CN-103838279-A translation (Year: 2014).*
(Continued)

*Primary Examiner* — Schyler S Sanks
(74) *Attorney, Agent, or Firm* — Womble Bond Dickinson (US) LLP

(57) ABSTRACT

Cooler control system for a beverage dispense system 1 having a beverage line (2) extending from a beverage source to a dispense site via a cooler (6). The cooler control system comprises: a controller (51) for adjusting the cooling of the beverage line; a flow rate sensor (41) measuring the flow rate in the beverage line, a temperature sensor (40); and an electronic control unit (31) for receiving a signal from the temperature sensor and/or the flow rate sensor and sending a signal to said controller. Cooler monitoring system comprising: at least one sensor (45) for monitoring energy consumption of the cooler (6); and an electronic control unit for receiving a signal from the at least one energy consumption sensor and for sending a signal to a remote location
(Continued)

when energy consumption increases above a predetermined maximum value.

6 Claims, 5 Drawing Sheets

(51) Int. Cl.

| | |
|---|---|
| ***B67D 1/12*** | (2006.01) |
| ***B67D 1/00*** | (2006.01) |
| ***B67D 1/07*** | (2006.01) |
| ***F25B 13/00*** | (2006.01) |
| ***F25B 49/02*** | (2006.01) |
| ***F25D 23/02*** | (2006.01) |

(52) U.S. Cl.
CPC ..... *B67D 1/07* (2013.01); *B67D 1/0867* (2013.01); *B67D 1/0888* (2013.01); *B67D 1/1252* (2013.01); *F25B 13/00* (2013.01); *F25B 49/02* (2013.01); *F25D 23/028* (2013.01); *B67D 1/0864* (2013.01); *B67D 2210/00089* (2013.01); *B67D 2210/00104* (2013.01)

(56) References Cited

U.S. PATENT DOCUMENTS

| | | | | |
|---|---|---|---|---|
| 6,330,806 | B1 * | 12/2001 | Beaverson | G05B 19/0426 62/201 |
| 2003/0061825 | A1 * | 4/2003 | Sullivan | B60H 1/3225 62/126 |
| 2004/0232173 | A1 | 11/2004 | Saveliev et al. | |
| 2011/0225997 | A1 * | 9/2011 | Gast, Jr. | F28F 27/003 62/121 |
| 2012/0291871 | A1 | 11/2012 | Schneider | |
| 2013/0062366 | A1 * | 3/2013 | Tansey | A47J 31/44 222/102 |

FOREIGN PATENT DOCUMENTS

| | | | | | |
|---|---|---|---|---|---|
| GB | 2 236 180 | A | | 3/1991 | |
| GB | 2 249 380 | A | | 5/1992 | |
| GB | 2249380 | A | * | 5/1992 | B67D 1/0867 |
| GB | 2 502 631 | A | | 12/2013 | |
| GB | 2505869 | A | | 3/2014 | |
| WO | WO-98/42612 | A2 | | 10/1998 | |
| WO | 2004/096694 | A1 | | 11/2004 | |
| WO | WO-2004/096694 | A1 | | 11/2004 | |
| WO | WO-2009/019457 | A2 | | 2/2009 | |
| WO | WO-2010/089108 | A1 | | 8/2010 | |
| WO | 2011/040641 | A1 | | 4/2011 | |
| WO | 2012/178044 | A1 | | 12/2012 | |

OTHER PUBLICATIONS

International Search Report and Written Opinion of International Search Authority for International Patent Application No. PCT/GB2015/052306 dated Jan. 22, 2016, 21 pages.

Examination Report in the corresponding GB Application No. GB1414425.7, dated Oct. 27, 2020.

Examination Report in the corresponding EP Application No. EP 15749873.4, dated Feb. 10, 2021.

Humidity, Dew Point, Temperature, Moisture in Oil, Carbon Dioxide, Pressure, Water. In: Vaisala, 2012. 184 pages.

* cited by examiner

BEVERAGE DISPENSE SYSTEMS AND BEVERAGE COOLERS

CROSS-REFERENCE TO RELATED APPLICATIONS

This application is a national stage application filed under 35 U.S.C. 371 of International Application No. PCT/GB2015/052306, filed Aug. 10, 2015, which claims priority from Patent Application No. GB 1414425.7, filed Aug. 14, 2014, each of which is incorporated by reference herein in its entirety.

The present invention relates to a cooler control system, a cooler monitoring system, a gas monitoring system and a control module for a beverage dispense system, and a beverage system incorporating such a cooler control system, cooler monitoring system, gas monitoring system and control module.

BACKGROUND

Many beverages including beers, lagers and ciders are beneficially served at low temperatures. If the temperature of the beverage is too high, the quality and the taste of the beverage may be impaired. In addition, recent consumer trends have increased the demand for beverages to be served at a lower temperature, for example, below 3° C. In order to meet consumer expectations, it is desirable to dispense beverages at a consistent low temperature.

Systems are known for dispensing draught beverages. By "draught beverages" is meant beverages which are stored at a point remote from the point of dispensing and transferred on demand to the point of dispensing through a beverage line. Typically the transfer is achieved using gas top pressure and pumping mechanism. For instance, it is common in public houses and bars for beverages to be stored in a cooled cellar or a storage room (typically cooled to a temperature of around 12° C. using a cooling unit) and transferred to the bar area where dispensing occurs at a font using a mechanical pump or a pressurised gas system.

The length of the beverage line between the cellar/storage room and the dispensing site may be many metres (e.g. up to 30 m or more) and there is a tendency for beverage in the beverage lines to increase in temperature during transit. In an attempt to address this problem, it is known to provide a cooler in or near the cellar/storage room to cool the beverage and then to transport the beverage to the dispensing site inside an insulated and cooled conduit known as a "python". The cooler typically comprises an ice bank and a water/coolant bath, the water/coolant in the water/coolant bath being cooled by the ice bank.

The beverage line passes from the cellar/storage room through the water/coolant bath and beverage contained in the beverage line is thus cooled. The cooled beverage then flows through the python to the dispensing site, the python also carrying a cooling circuit through which cold water/coolant from the water/coolant bath is circulated. It is also known to use a glycol cooling medium in the cooler and cooling circuit to effect even greater cooling for beverages which are intended to be served "extra cold".

Problems are associated with the consistency of the beverage temperature at the dispense site. In times of high demand, the flow of beverage through the beverage line within the cooler water bath will increase and thus the amount of time for heat exchange between the beverage and the water bath (and thus the amount of time for beverage cooling) will decrease thus meaning that the beverage dispense temperature can rise during periods of high demand. Conversely, during periods of low demand when beverage may remain within the beverage line immersed in the water bath for extended periods of time, the dispense temperature may decrease.

Furthermore, fluctuations in the temperature within the cellar/storage room and at the dispense site may also affect the ultimate dispense temperature.

It is known to provide the cooler with a controller that controls the growth of the ice bank and the circulation of cooling medium through the cooling circuit based on time of day, day of the week and, in some cases, day of the year e.g. ice bank growth and flow in the cooling circuit is minimised/stopped outside trading hours and increased during trading hours.

However, whilst known cooler controllers adjust cooling based upon predicted requirements determined by time of day/day of week, etc., they do not take account of unpredictable fluctuations in demand and cellar/storage room and dispense site temperature.

There is a desire for information concerning draught beverage dispense systems to be sent to remote locations such as to the beverage outlet head office, to the beverage source supplier (e.g. a brewery), to the provider of the beverage dispense system hardware and to the technicians/engineers responsible for technical support and maintenance of the beverage dispense system. This information can be used for various purposes e.g. to monitor beverage sales and brand performance, to make predictions concerning future supply requirements and to monitor hardware performance with a view to carrying out technical maintenance.

A system known as iDraught provided by the Brulines Group includes temperature sensors provided in the cellar, associated with the remote cooler and in the beverage lines under the bar counter and flow rate sensors in the beverage lines under the bar counter to provide dispense quality and quantity information to a remote location using the mobile phone communications network. Any rises in temperature detected by the temperatures sensors result in an alarm at the remote location. There is no feedback provided to the remote cooler to try and correct the cooling issue and so the cooling issue may persist for a significant length of time until a technician/engineer can attend the site. Furthermore, the iDraught system only triggers action once the temperature rise has occurred and does not allow preventative measures to avoid temperature rises before they occur.

The iDraught system does not monitor the pressurized gas system used to force the beverage from the beverage supply so any faults in the gas system are not alerted to the remote location.

Individuals attending the cellar/storage room, e.g. technicians or engineers responding to alarms generated by the iDraught system, are at risk if there are leakages in the pressurised gas system. Furthermore, for the convenience of individuals attending the cellar/store room and for energy consumption savings, there is a desire to provide responsive lighting in the cellar/storage room.

The present invention aims to address at least some of the issues associated with the prior art.

SUMMARY OF THE INVENTION

In a first aspect, the present invention provides a cooler control system for a beverage dispense system having a beverage line extending from a beverage source to a dispense site via a cooler, said cooler control system comprising:

a controller for adjusting the extent of cooling of the beverage line;

at least one flow rate sensor for measuring the flow rate of beverage in the beverage line and/or at least one temperature sensor; and an electronic control unit for receiving a signal from the at least one temperature sensor and/or at least one flow rate sensor and for sending a signal to the controller to adjust the extent of cooling of the beverage line.

In a second aspect, the present invention provides a beverage dispense system, said system comprising:

a beverage line extending from a beverage source to a dispense site;

a cooler for cooling beverage within the beverage line; and a cooler control system according to the first aspect.

In a third aspect, the present invention provides a method of controlling cooling of a beverage in a beverage dispense system according to the second aspect, said method comprising:

providing a cooler control system according to a first aspect, monitoring the flow rate and/or temperature of beverage in the beverage line and/or monitoring the ambient temperature proximal the beverage supply or at the dispense site;

transmitting a first signal from the at least one sensor to the electronic control unit;

transmitting a second signal from the electronic control unit to the controller; and adjusting the cooling of the beverage line upon receipt of the second signal by the controller.

The electronic control unit (ECU) can send a signal to the controller to control the extent of beverage cooling by the cooler based on the feedback obtained by the at least one sensor. For example, if a raised temperature and/or a high flow rate is detected by the sensor(s), the ECU can send a signal to the controller to increase beverage cooling. This means that a consistent temperature of beverage can be obtained at the dispense site even when unpredictable fluctuations in beverage demand and/or ambient temperature occur.

The cooler control system preferably comprises at least one temperature sensor and at least one flow rate sensor.

The or each temperature sensor may comprise a thermocouple, a thermistor, a resistance thermometer or an infrared probe.

In some embodiments, the or each temperature sensor is configured to send a signal to the ECU when a predetermined maximum and/or minimum temperature is detected.

When the predetermined maximum temperature is detected, the ECU can trigger the cooler (via the controller) to increase cooling to ensure that the beverage is sufficiently cooled.

When the predetermined minimum temperature is detected, the ECU can trigger the cooler (via the controller) to reduce cooling to ensure that the beverage is not over-chilled (and spoiled).

The or each flow rate sensor may be a mechanical flow rate sensor e.g. a (rotary) piston meter, a gear meter, a rotameter or a turbine flow meter. The flow rate meter may be a pressure-based meter e.g. a venture meter, an impact probe or a cone meter. The flow rate sensor may be an optical flow meter. The flow rate sensor may be an electromagnetic, ultrasonic or coriolis flow meter.

In some embodiments, the or each flow rate sensor is configured to send a signal to the ECU when a predetermined maximum and/or minimum flow rate is detected.

When the predetermined maximum flow rate is detected, the ECU can trigger the cooler (via the controller) to increase cooling in line with the increased beverage demand to ensure that the beverage is sufficiently cooled.

When the predetermined minimum flow rate is detected, the ECU can trigger the cooler (via the controller) to reduce cooling in line with reduced demand to ensure that the beverage is not over-chilled (and spoiled).

The sensor(s) are configured to transmit the signal to the ECU via a transmission path which may be a wired or a wireless transmission path.

The ECU is configured to transmit the signal to the controller via a second transmission path which may be a wired or a wireless transmission path.

In some embodiments, the cooler is an ice bank cooler and the controller is for controlling the growth of the ice bank. Accordingly, upon receipt of a signal from the ECU, the controller may increase or decrease the growth of the ice bank.

In some embodiments, the controller is mounted within or on the cooler.

In some embodiments, the ECU may be mounted within or on the cooler. In some embodiments, the ECU may be mounted on a wall in the cellar/storage room. In some embodiments, the ECU may be mounted within or on a control module (which may be as described below for the tenth aspect of the present invention) which may be mounted on a wall of ceiling of the cellar/storage room.

A temperature sensor may be provided proximal the beverage source e.g. in a cellar/storage room for monitoring the ambient temperature of the cellar/storage room.

A temperature sensor may be provided at the dispense site for monitoring the ambient temperature of the dispense site.

One or more temperature sensors may be provided in heat exchange relationship with the beverage line (e.g. adjacent or within the beverage line) to monitor the temperature of beverage within the beverage line. A plurality of temperature sensors may be provided in heat exchange relationship with the beverage line. For example, one temperature sensor may be provided adjacent or in the beverage line between the beverage source and the cooler and a second temperature sensor may be provided adjacent or in the beverage line between the cooler and the dispense site.

The or each flow sensor may be provided within the beverage line.

In some embodiments, at least a portion of the beverage line is enclosed within an insulated carrier e.g. a python-type carrier (which comprises a tubular sleeve formed of insulating plastics material) and the insulated carrier comprises a cooling circuit comprising a cooling line and a cooling return line for carrying chilled cooling medium, the cooling lines being in heat exchange relationship with the beverage line within the insulated carrier. In these embodiments, at least one temperature sensor may be provided within the cooling circuit (e.g. within the cooling line and/or cooling return or in heat exchange relationship with the cooling line and/or cooling return line) to monitor the temperature of the chilled cooling medium.

The chilled cooling medium may be generated by the cooler or the beverage dispense system may comprise a separate cooling medium generator.

Where the cooling medium is generated by the cooler, the controller may be adapted to adjust the flow rate of cooling medium within the insulated carrier cooling circuit in response to the signal from the ECU. For example, where a rise in temperature of the beverage within the beverage line or at the cellar/storage room/dispense site or an increase in beverage flow rate triggers a signal to the controller from the temperature/flow rate sensor(s) (via the ECU), the flow rate within the cooling circuit can be increased to increase cooling of the beverage in the beverage line within the insulated carrier.

Where the beverage dispense system comprises a cooling medium generator, the system preferably further comprises a cooling medium generator controller and the ECU is adapted to send a third signal to the cooling medium generator controller to adjust the flow rate of the cooling medium in the cooling circuit of the insulated carrier in response to the signal from the ECU.

In these embodiments, the ECU may configured to transmit the third signal to the cooling medium generator controller via a third transmission path which may be a wired or a wireless transmission path.

In some embodiments, the at least one flow rate meter is adapted to determine the throughput of beverage through the beverage line and/or volume of beverage dispensed.

The ECU can be adapted to send the beverage throughput and dispense volume and/or data relating to cellar/store room/dispense site ambient temperature and beverage temperature to a remote location (e.g. to the beverage outlet head office, to the beverage source supplier, to the provider of the beverage dispense system hardware and to the technicians/engineers responsible for technical support and maintenance of the beverage dispense system). The ECU may be adapted to send this data to the remote location via wireless transmission path such as via a mobile phone network communications network.

Accordingly, the cooler control system of the present invention can additionally act to provide dispense quality and quantity data to interested parties at the same time as ensuring a consistent low dispense temperature i.e. it allows correction of an undesirable dispense temperature rather than simply alerting a third party that an undesirable dispense temperature is present.

The ECU may be adapted to receive an over-ride signal from the remote location (e.g. via a mobile phone network communications network) and to send a signal to the controller upon receipt of the over-ride signal to adjust the cooling of the beverage line (e.g. by increasing/decreasing ice bank growth and/or by increasing or decreasing rate of flow around the cooling circuit). This allows the cooling of the beverage to be increased or decreased remotely for example if the individual at the remote location is aware of an upcoming likelihood of increased beverage demand or it the individual suspects some error in the system.

In a fourth aspect, the present invention provides a cooler monitoring system for a beverage dispense system having a beverage line extending from a beverage source to a dispense site via a cooler, said cooler monitoring system comprising:

- at least one energy consumption sensor for monitoring energy consumption of the cooler;
- an electronic control unit for receiving a signal from the at least one energy consumption sensor and for sending a signal to a remote location when energy consumption increases above a predetermined maximum value.

In a fifth aspect, the present invention provides a beverage dispense system, said system comprising:

- a beverage line extending from a beverage source to a dispense site;
- a cooler for cooling beverage within the beverage line; and
- a cooler monitoring system according to the fourth aspect.

In a sixth aspect, the present invention provides a method of monitoring a cooler in a beverage dispense system according to the fifth aspect, said method comprising:

- providing a cooler monitoring system according to a fourth aspect,
- monitoring the energy consumption of the cooler;
- transmitting a first signal from the at least one energy consumption sensor to the electronic control unit when energy consumption increases above a predetermined maximum value;
- transmitting a second signal from the electronic control unit to a remote location upon receipt of the first signal by the ECU.

By providing a cooler monitoring system that monitors energy consumption of the cooler and sends a signal to a remote location when energy consumption increases, individuals (e.g. technicians/engineers) can be alerted to a fault in the cooler before it becomes critical so that the fault can be addressed as soon as possible and, hopefully, before any rise in beverage dispense temperature occurs.

The at least one energy consumption sensor is preferably adapted for monitoring the energy consumption (e.g. watts per hour) of the cooler compressor.

In some embodiments, the ECU for receiving the signal from the energy consumption sensor may be mounted within or on the cooler. In some embodiments, the ECU for receiving the signal from the energy consumption sensor may be mounted on a wall in the cellar/storage room. In some embodiments, the ECU for receiving the signal from the energy consumption sensor may be mounted within or on a control module (which may be as described below for the tenth aspect of the present invention) which may be mounted on a wall of ceiling of the cellar/storage room.

The ECU for receiving the signal from the energy consumption sensor may be adapted to send the signal to the remote location via wireless transmission path such as via a mobile phone network communications network.

The cooler control system of the first aspect and the beverage dispense system of the second aspect may be combined with the cooler monitoring system of the fourth aspect and the beverage dispense system of the fifth aspect respectively. In this case, there may be a single ECU adapted to receive signals from the temperature/flow rate sensor(s) and from the energy consumption sensor(s). Alternatively, there may be two separate ECUs, one for receiving signals from the temperature/flow rate sensor(s) and one for receiving signals from the energy consumption sensor(s).

In a seventh aspect, the present invention provides a gas monitoring system for a beverage dispense system having a beverage line extending from a beverage source to a dispense site and a gas line extending from a gas source to the beverage source, said gas monitoring system comprising:

- at least one pressure sensor for monitoring gas pressure within the gas line and/or at least one gas concentration detector for monitoring gas concentration outside the gas line;
- an electronic control unit for receiving a signal from the at least one pressure sensor and/or the at least one gas concentration detector and for sending a signal to a remote location when gas pressure decreases below a predetermined minimum level and/or gas concentration increases above a predetermined maximum level.

In an eighth aspect, the present invention provides a beverage dispense system, said system comprising:

a beverage line extending from a beverage source to a dispense site;

a gas line extending from a gas source to the beverage source; and a gas monitoring system according to the seventh aspect.

In a ninth aspect, the present invention provides a method of monitoring gas in a beverage dispense system according to the eighth aspect, said method comprising:

providing a gas monitoring system according to the seventh aspect, monitoring gas pressure within the gas line and/or gas concentration outside the gas line;

transmitting a first signal from the at least one pressure sensor and/or gas concentration detector to the electronic control unit when gas pressure decreases above a predetermined minimum value and/or gas concentration increases above a predetermined maximum level;

transmitting a second signal from the electronic control unit to a remote location upon receipt of the first signal by the ECU.

By providing a gas monitoring system that monitors gas pressure and/or gas concentration in the cellar/storage room and sends a signal to a remote location when the pressure drops and/or the concentration increases, individuals (e.g. technicians/engineers) can be alerted to a fault e.g. a leak in the gas line/gas source before it becomes critical so that the fault can be addressed as soon as possible.

The at least one pressure sensor may be mounted at any point within the gas line e.g. at the primary gas valve or within a control module (which may be as described below for the tenth aspect of the present invention) which may be mounted on a wall of ceiling of the cellar/storage room.

The at least one gas concentration detector is preferably at least one carbon dioxide concentration detector. It/they may be mounted in the cellar/storage room e.g. proximal the gas source and/or proximal the beverage source.

In some embodiments, the ECU for receiving the signal from the pressure sensor/gas concentration detector may be mounted on a wall in the cellar/storage room. In some embodiments, the ECU for receiving the signal from the pressure sensor/gas concentration detector may be mounted within or on a control module (which may be as described below for the tenth aspect of the present invention) which may be mounted on a wall of ceiling of the cellar/storage room.

The ECU for receiving the signal from the pressure sensor/gas concentration detector may be adapted to send the signal to the remote location via wireless transmission path such as via a mobile phone network communications network.

In some embodiments, the gas monitoring system further comprises an alarm for indicating when the pressure sensor and/or the gas concentration detector has sent a signal to the ECU. The alarm may comprise an audible or visual alarm. The alarm may be mounted on a wall in the cellar/storage room. In some embodiments, the alarm may be mounted within or on a control module (which may be as described below for the tenth aspect of the present invention) which may be mounted on a wall of ceiling of the cellar/storage room. The alarm may be triggered by receiving a signal from the ECU upon receipt of the signal by the ECU from the pressure sensor/gas concentration detector.

The cooler control system of the first aspect and the beverage dispense system of the second aspect and/or the cooler monitoring system of the fourth aspect and the beverage dispense system of the fifth aspect may be combined with the gas monitoring system of the seventh aspect and the beverage dispense system of the eighth aspect. In this case, there may be a single ECU adapted to receive signals from the temperature/flow rate sensor(s) and/or from the energy consumption sensor(s) and from the pressure sensor/gas concentration detector. Alternatively, there may be two or three separate ECUs, e.g. one for receiving signals from the temperature/flow rate sensor(s), one for receiving signals from the energy consumption sensor(s) and one for receiving signals from the pressure sensor/gas concentration detector.

The alarm alerts individuals e.g. bar staff entering the cellar storage room that a gas leak is present.

In a tenth aspect, the present invention provides a control module for a beverage dispense system having a beverage line extending from a beverage source to a dispense site, said control module comprising a motion detector and/or a camera.

In some embodiments, the control module additionally comprises a light source.

By providing a control module having a motion sensor and a light source, the motion sensor can detect motion within the cellar/storage room and trigger the illumination of the light source. The camera can be used to provide an image signal to a remote location e.g. the dispense site. The camera can also function as the motion sensor to trigger illumination of the light source.

The light source may also function as emergency lighting or a further emergency light source may be provided along with a power source (e.g. battery pack) which may be contained within the module to illuminate the cellar/store room in the event of a power failure.

The motion sensor or camera can be used to trigger the illumination of the light source or the emergency lighting source by the power source in the event of a power failure.

The motion sensor may be mounted on a casing of the module or may be located within the module casing adjacent a motion sensor window.

The camera may be mounted on the module casing or contained within the module casing adjacent a camera window.

The camera is preferably adapted to provide images to a remote location e.g. to the dispense site e.g. via a wireless transmission path.

The module of the tenth aspect may be used in combination with the cooler control system and/or cooler monitoring system and/or gas monitoring system as previously described. The ECU(s) of those systems may be contained within the module optionally along with one or more of the sensors. This provides a compact, hygienic solution. Furthermore, any camera on the module can be used to monitor the visible alarm generated by the gas monitoring system in the event of a gas leakage.

In some embodiments, the module is adapted for mounting on wall or ceiling. For example, the module may include fixings for mounting onto a bracket affixed to the wall/ceiling.

The module may include passageway for receiving the beverage line and/or gas line. The passageway(s) extend within an insulating core housed in the module casing.

Preferred embodiments of the present invention will now be described with reference to the accompanying Figures in which.

DETAILED DESCRIPTION OF THE INVENTION

Figure 1:
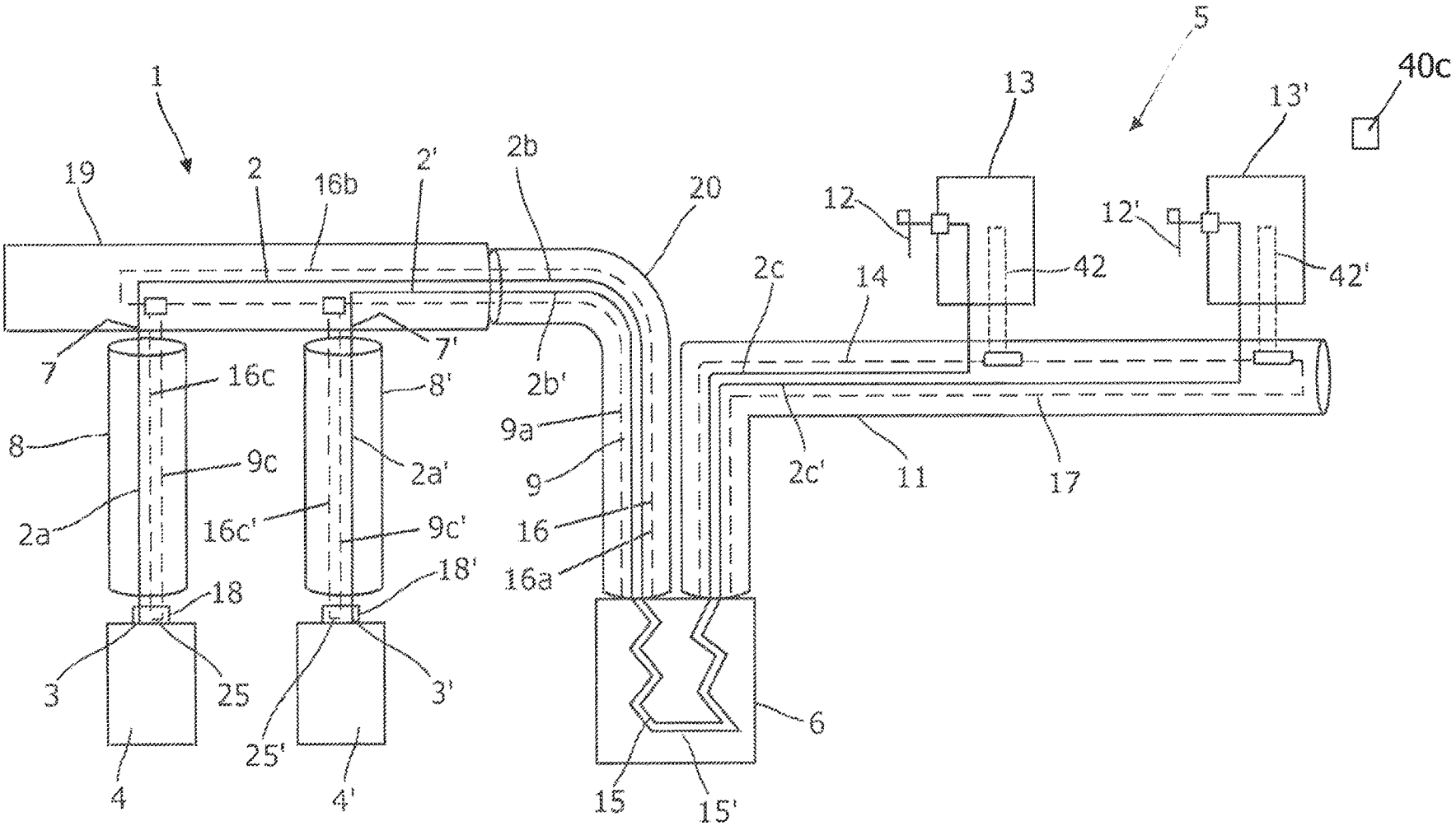
FIG. 1 shows a schematic representation of a first embodiment of a beverage dispense system according to the present invention.

FIG. 1 shows a beverage dispense system 1 for dispensing two beverages. The system comprises: two beverage lines 2, 2' each having a distal end 3, 3' connectable to a respective beverage supply 4, 4' for transporting beverage from each beverage supply 4, 4' to a dispense site 5 having two dispense fonts 13, 13' each with a respective tap 12, 12' through which the beverage is dispensed.

The system further comprises a cooler 6 for cooling beverage. The cooler 6 is adapted to generate cooling medium. The cooler 6 comprises an ice bank and a cooling medium reservoir (not shown), the cooling medium in the cooling medium reservoir being cooled by the ice bank.

Each beverage line 2, 2' comprises a distal beverage line portion 2*a*, 2*a'* extending from the respective distal end 3, 3' to a respective beverage line inlet 7, 7' of a control module 19. Each distal beverage line portion 2*a*, 2*a'* extends within a first insulated carrier 8, 8' which is a python-type insulated carrier. The beverage lines continue through a foam core 33 within the control module 19 (see FIG. 2) to a beverage line outlet 10 where the proximal beverage line portions 2*b*, 2*b'* run within a single second insulated carrier 20 which is a further python type insulated carrier.

A first cooling line 9 for transporting cooling medium (generated by the cooler 6) through:

a) the second carrier cooling line 9*a* in the second insulated carrier 20;

b) the control module cooling line 9*b* in the core 33 of the control module 19; and c) then through the two first carrier cooling lines 9*c*, 9*c'* in the first insulated carriers 8, 8', is provided so as to allow heat exchange between the cooling medium in the first cooling line 9 and the beverage in the beverage lines 2, 2'.

The first cooling line 9 forms part of a first system cooling circuit, the first system cooling circuit including the first cooling line 9 extending from the cooler 6 through the second insulated carrier portion 20, the control module 19 and first insulated carriers 8, 8' to each beverage supply 4, 4' and a first return line 16 returning the cooling medium to the cooling medium reservoir of the cooler 6.

The first cooling return line 16 comprises the first carrier cooling lines 16*c*, 16*c'*, the control module cooling return line 16*b* and the second carrier cooling return line 16*a*.

The first cooling line 9 and first return line 16 typically have a diameter of 9.5 mm (in the distal first insulated carrier portions) and 15 mm (within the control module 19 and the proximal first insulated carrier portion).

The beverage lines 2, 2' further comprise a portion 2*c*, 2*c'* for transporting beverage from the cooler 6 to the respective tap 12, 12' on the respective dispense font 13, 13' at the dispensing site 5 through a third insulated carrier 11. The third insulated carrier 11 comprises a second cooling line 14 for transporting cooling medium (from the cooler 6) through the third insulated carrier 11 so as to allow heat exchange between the cooling medium in the second cooling line 14 and the beverage in the beverage line portions 2*c*, 2*c'*.

The second cooling line 14 preferably forms part of a second system cooling circuit, the second cooling circuit including the second cooling line 14 extending from the cooler 6 through the third insulated carrier 11 to the dispense site 5 and a second return line 17 extending from the dispense site 5 through the third insulated carrier 11 to the cooling medium reservoir of the cooler 6. The second cooling line and second return line typically have a diameter of 15 mm.

The second system cooling circuit also includes a font cooling circuits 42, 42' which carry cooling medium into the font to allow heat exchange with the beverage line in the font to maintain the low temperature of the beverage and, optionally, to promote formation of condensation on the outer surface of the font (for aesthetic reasons). The lines in the font cooling circuit typically have a diameter of around 9.5 mm (⅜ inch).

Each beverage line 2, 2' includes a respective cooling beverage line portion 15, 15' that passes through the cooling medium reservoir. Each cooling beverage line portion 15, 15' is a coiled portion that can be immersed in the cooling medium in the reservoir. The amount of coil immersed can be varied to determine the extent of heat exchange and hence the extent of cooling of the beverage.

At the distal ends 3, 3' of the beverage lines is provided a respective connector 18, 18'.

Figure 2:
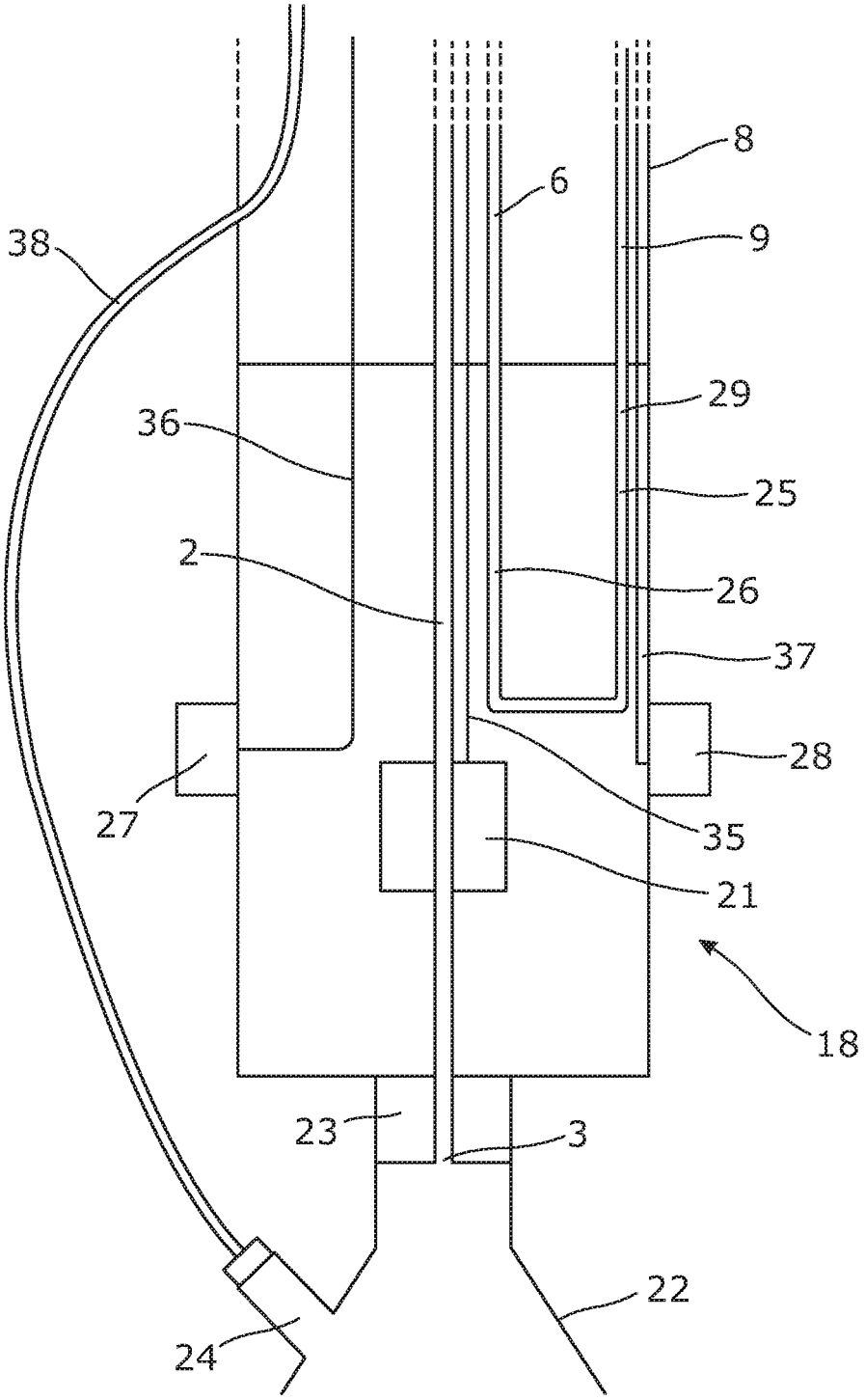
FIG. 2 shows a schematic representation of a connector for use in the beverage system shown in FIG. 1.

A connector which is connected to a standard keg coupler 22 is shown in FIG. 2.

The connector 18 includes a bubble sensor 21 for sensing bubbles within the beverage line 2 and for generating a signal for closing the beverage line (using a solenoid valve—shown in FIG. 3) when a predetermined level of bubbles (e.g. a single bubble) is detected.

The connector has a push fit element 23 for fitting to the standard keg coupler 22 (i.e. a coupler which connects to the top of the keg spear and which has a gas line inlet 24).

The sensor is an optical sensor having an optical transmitter and an optical receiver as described in GB2236180.

The connector contains a connector cooling circuit 25 comprising a connector cooling line 29 for receiving cooling medium from the first cooling line 9 and a connector cooling return line 26 for returning cooling medium to the first cooling return line 16. The connector cooling medium circuit is in heat exchange relationship with the beverage line 2 within the connector for cooling the beverage as it leaves the storage keg.

The connector 18 further comprises a connector indicator 27 for providing an indication when the bubble sensor 21 has generated a signal for closing the beverage line 2. The connector indicator 27 is a light which changes from green to red when the beverage line 2 is closed. The red light shines onto the beverage supply (storage keg) to highlight to the user which keg needs changing.

The connector further comprises a connector re-set actuator 28 (button) which is operable to generate a signal to re-open the beverage line 2 once the beverage supply 4 has been replenished (i.e. the storage keg changed). The connector re-set actuator 28 is also operable to re-set the connector indicator 27 i.e. to turn the red light back to green.

The first insulated carrier 8 also contains a gas line 38 (shown in FIG. 2) which connectable to a gas (carbon dioxide) supply at one end and connectable to the gas inlet 24 on the keg coupler 22 at its other end. The gas line exits the first insulated carrier 8 before it joins the connector 18.

Figure 3:
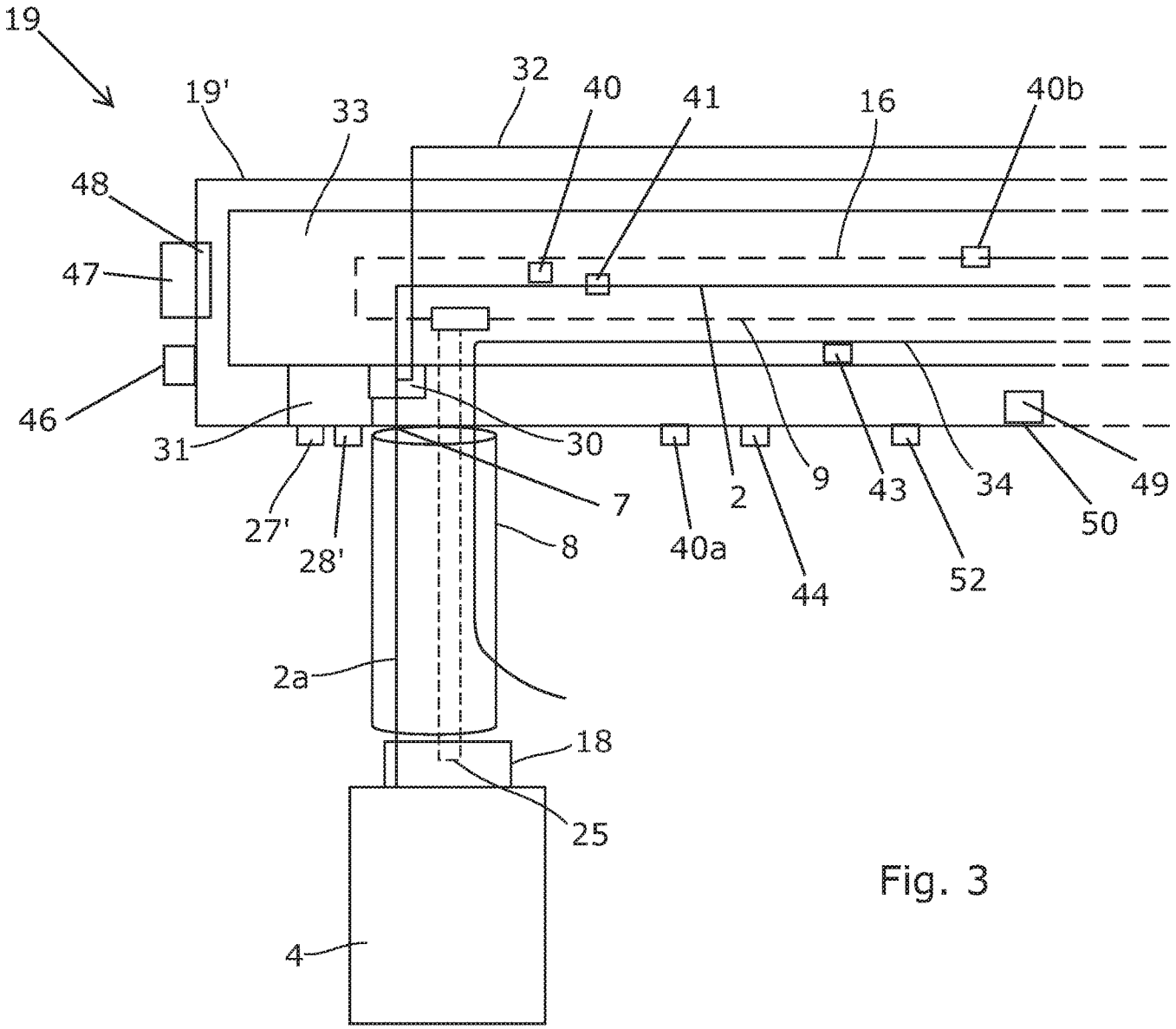
FIG. 3 shows an enlarged schematic representation of the control module of the beverage system shown in FIG. 1.

FIG. 3 shows an enlarged view of a portion of the control module 19 showing the foam core 33 and the solenoid valve 30 which is operable to close the beverage line upon receipt of the signal from the bubble sensor 21 in the connector by an electronic control unit (ECU) 31 within the control module.

The valve 30 is a two-way valve which can either direct beverage from the beverage supply 4 towards the dispense site 5 or towards a bleed line 32 which exits the control module 19 and is directed towards a drain or storage tank.

The control module 19 is provided with a control module indicator 27' for providing a further indication when the bubble sensor 21 has generated a signal for closing the beverage line 2. The control module indicator 27' is also a light which changes from green to red when the beverage line 2 is closed. The red light shines onto the first insulated carrier portion 8.

The connector re-set actuator 28 is also operable to re-set the control module indicator 27' i.e. to turn the red light back to green.

Additionally, the control module comprises a control module re-set actuator 28' which is operable to re-set the control module indicator 27' and/or the connector indictor 27 i.e. to turn the red light(s) back to green.

The valve 30 and ECU 31 are contained within a casing 19' of the control module 19 whilst the control module indicator 27' and control module re-set actuator 28' are mounted on the outside of the control module casing 19'.

Figure 4:
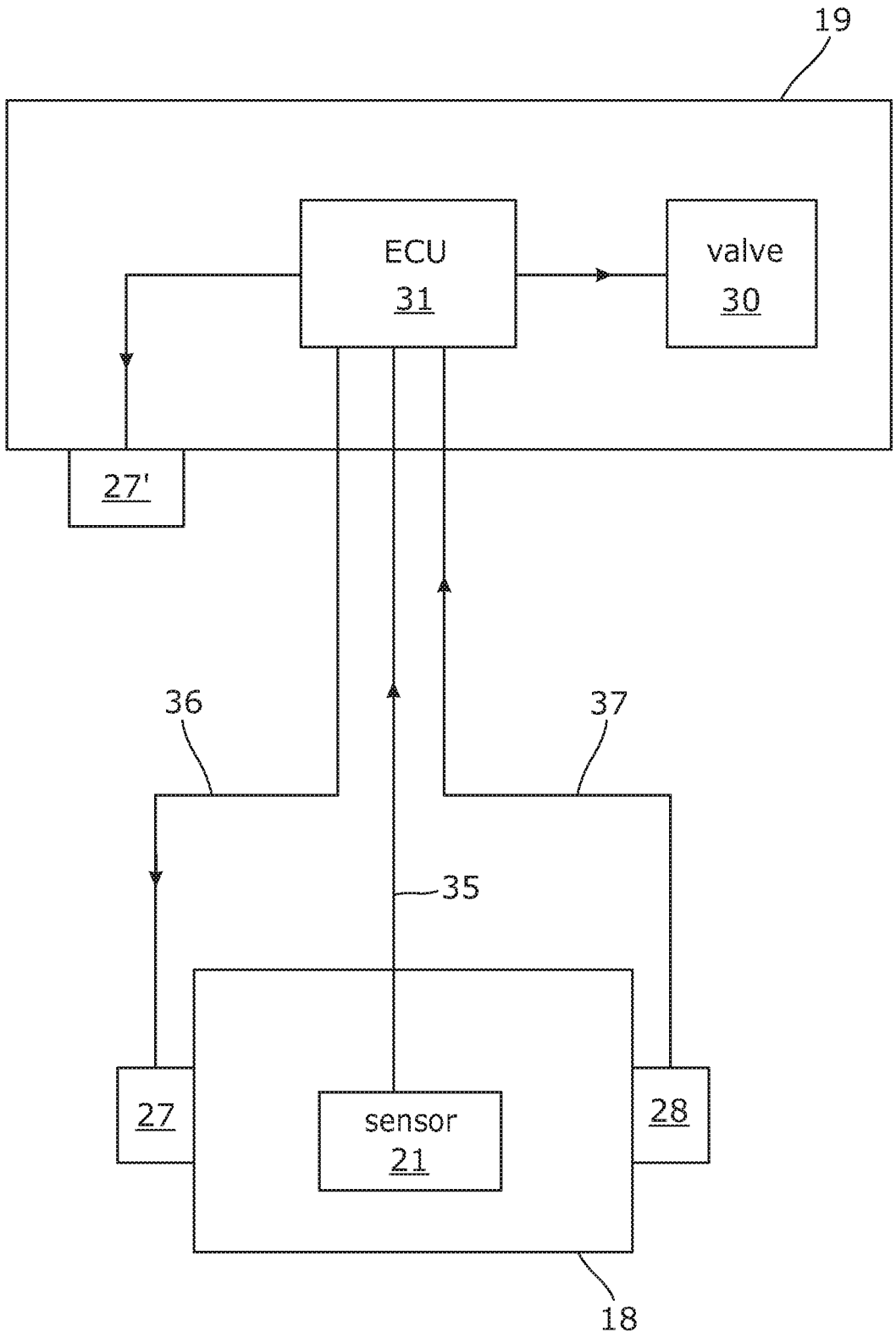
FIG. 4 shows a schematic representation of a method of changing a beverage supply.

The bubble sensor 21, valve 30, control module/connector indicators 27, 27' and control module/connector re-set actuators are provided to assist in the changing of a depleted beverage supply as discussed below with reference to FIG. 4.

Upon sensing a predetermined level of bubbles in the beverage line using the bubble sensor 21, a signal is generated and passed along the first insulated carrier 8 through wire 35 to the ECU 31.

Upon receipt of this signal the ECU 31 sends a signal to the solenoid valve 30 causing it to close the beverage line.

The ECU 31 also sends a signal to the control module indicator 27' and to the connector indicator 27 via wire 36 to activate the indicators i.e. to turn the lights from green to red.

A user entering the beverage supply site can immediately see which beverage supply (storage keg) requires changing by observing the indicators 27, 27'.

The user will disconnect the depleted beverage supply by removing the connector 18 from the beverage supply and will then connect the connector to a new beverage supply.

At this time, the user will depress the connector re-set actuator button 28 or the control module re-set actuator button 28' using a single, short depression which will send a signal to the ECU 31 via wire 37. The ECU 31 will send a signal to the solenoid valve 30 which will open the beverage line 2 to the bleed line 32 to discharge any fob from the line.

After a predetermined amount of time (determined from the length of the beverage line between the bubble sensor 21 and the valve 30 and from the flow rate of the beverage), the valve closes the bleed line and re-establishes fluid communication along the length of the beverage line so that beverage can be transported to the dispense site 5.

The ECU will then send a signal to the control module indicator 27' and to the connector indicator 27 via wire 36 to deactivate the indicators i.e. to turn the red lights back to green.

Every 4 weeks, it will be necessary effect cleaning of the beverage line 2, 2'. In this case, after disconnection of the depleted beverage supply, the user will connect a water/cleaning fluid supply to the distal end 3, 3' of the beverage line and will actuate the control module or connector re-set actuator 28, 28' in the second mode of actuation (by effecting a prolonged depression of the button). This will cause the valve 30 to reconnect the beverage line to allow pumping of the water/cleaning fluid through the beverage line.

Referring again to FIG. 3, the control module 19 additionally comprises a flow rate sensor 41 associated with the beverage line 2 within the control module 19 for monitoring the flow rate of beverage within the beverage line and a temperature sensor 40 for monitoring the temperature of beverage within the beverage line. A temperature sensor 40*a* is also provided on the control module casing for measuring the ambient temperature within the cellar/store room. A further temperature sensor 40*b* is provided within the first cooling return line 16 to monitor the temperature of the chilled cooling medium. A yet further temperature sensor 40*c* (see FIG. 1) is provided at the dispense site for monitoring the ambient temperature at the dispense site. These sensors along with the ECU and a controller 51 provided on the cooler 6 form a cooling control system according to the first aspect of the present invention.

Figure 5:
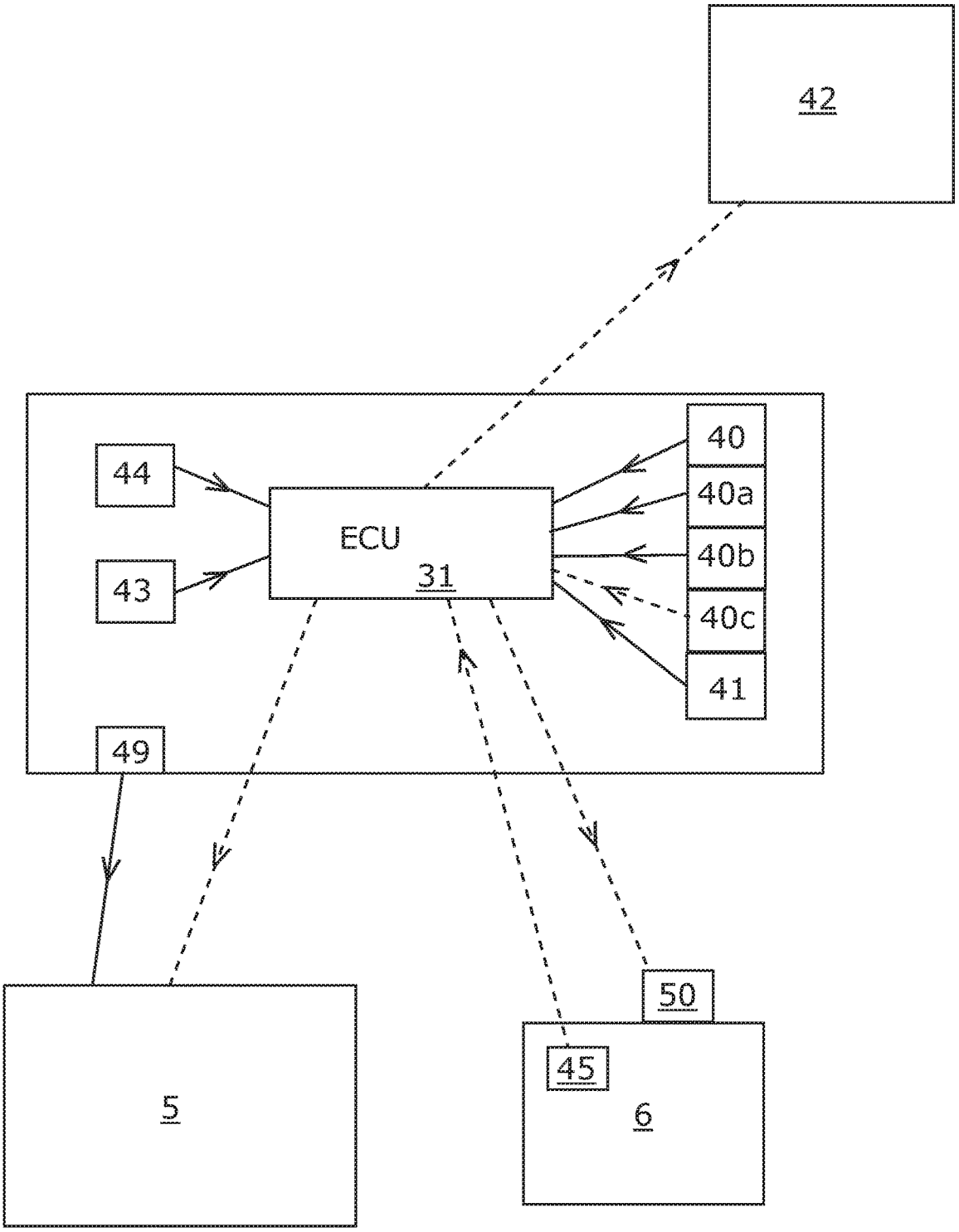
FIG. 5 shows a schematic representation of a method of controlling cooling of a beverage according to the third aspect of the present invention.

As shown in FIG. 5, the temperature sensors 40, 40*a*, 40*b* and 40*c* monitor: a) the temperature of beverage in the beverage line (sensor 40); b) the ambient temperature in the cellar/store room (sensor 40*a*); c) the temperature of the cooling medium in the first system cooling circuit (sensor 40*b*); and the ambient temperature at the dispense site (sensor 40*c*).

If one or more of the temperature sensors (40, 40*a*, 40*b*, 40*c*) detect a temperature that is above a predetermined maximum value or below a predetermined minimum value, or if the flow rate sensor 41 detects a flow rate that is above a predetermined maximum value or below a predetermined minimum value, a signal is sent from the sensor to the ECU 31. The transmission path for the signal from the sensors on/in the control module 19 are wired transmission paths i.e. wires extend between the temperature sensors (40, 40*a*, 40*b*) and the flow rate sensor 41 and the ECU. The transmission path between the temperature sensor 40*c* at the dispense site is a wireless transmission path.

Upon receipt of the signal from the temperature sensor(s) 40, 40*a*, 40*b*, 40*c* and/or the flow rate sensor 41, the ECU transmits a signal to the controller 51 mounted on the cooler 6. The controller 51 causes the cooler to adjust (i.e. increase or decrease cooling by increasing/decreasing growth of the ice bank) depending on whether the maximum or minimum value has been detected/exceeded.

The controller 50 may also adjust the flow rate of the chilled cooling medium around the first (and/or second) system cooling circuit depending on whether increased or decreased cooling is required.

Cooling is increased (ice bank growth increased) and optionally cooling medium circulation is increased where the sensors provide an indication to the ECU 31 that a predetermined maximum temperature or a predetermined maximum flow rate has been exceeded. This is an indication that demand and/or ambient temperature is unexpectedly high.

Cooling is decreased (ice bank growth reduced) and optionally cooling medium circulation is reduced where the sensors provide an indication to the ECU 31 that a predetermined minimum temperature or a predetermined minimum flow rate has been exceeded. This is an indication that demand and/or ambient temperature is unexpectedly low.

Accordingly, the beverage dispense system can use the feedback from the sensors to automatically adjust the beverage cooling to maintain a consistent beverage dispense temperature even in times of unpredictable demand/ambient temperature.

The flow rate sensor 41 additionally transmits data relating to beverage through-put, i.e. volumes dispensed, to a remote site 42 for access by a beverage outlet head office, to the beverage source supplier, to the provider of the beverage dispense system hardware or to the technicians/engineers responsible for technical support and maintenance of the beverage dispense system. The data is transmitted via the ECU 31 along a wireless transmission path e.g. a mobile phone communication network to the remote site 42 and, optionally, to the dispense site 5. This allows individuals at the remote site to monitor, for example, brand performance and dispense quality.

The cooler 6 comprises a compressor (not shown) having an associated energy consumption sensor 45. This sensor 45 along with the ECU 31 forms a cooler monitoring system according to the fourth aspect of the present invention.

It is typical that when a fault is developing in a cooler and/or the cooler is reaching the end of its service life, the compressor starts to lose efficiency and consume more energy. When the energy consumption reaches or exceeds a predetermined maximum value, the energy consumption sensor 45 sends a signal via a wireless transmission path to the ECU 31. This triggers the ECU 31 to send a signal to a remote location 42 (e.g. to a technician/engineer) via a mobile phone communications network to ensure that the cooler fault is rectified or the cooler replaced as soon as possible.

The control module 19 additionally comprises a gas pressure sensor 43 for measuring gas pressure in a gas line 34 running through the control module. A carbon dioxide detector 44 is also mounted on the control module 19. These sensors along with the ECU 31 form a gas monitoring system according to the seventh aspect of the present invention.

When a gas leakage occurs, the pressure in the gas line will drop and the concentration of carbon dioxide will increase. When the gas pressure drops below a predetermined minimum value and/or the carbon dioxide concentration reaches or exceeds a predetermined maximum value, the pressure sensor 43 and/or the carbon dioxide detector 44 sends a signal via a wired transmission path to the ECU 31. This triggers the ECU 31 to send a signal to a remote location 42 (e.g. to a technician/engineer) via a mobile phone communications network to ensure that the gas system fault is rectified as soon as possible.

Upon receipt of the signal from the pressure sensor 43 and/or the carbon dioxide detector 44, the ECU triggers a visual and audible alarm 52 to alert anyone entering the cellar/storage room that a gas leak exists.

The control module 19 comprises a motion sensor 46 and a light source 47 both mounted on the exterior of the control module casing. The motion sensor can detect motion within the cellar/storage room and trigger the illumination of the light source (optionally via the ECU).

The light source 47 may also function as emergency lighting along with a power source 48 (e.g. battery pack) which is contained within the control module casing 19' to illuminate the cellar/store room in the event of a power failure.

Finally, the control module comprises a camera 49 which is contained within the control module casing adjacent a camera window 50. The camera can be used to provide an image signal to a remote location e.g. the dispense site 5. This can be used to monitor actuation of the alarm 52.

The invention claimed is:

1. A cooler monitoring system for a beverage dispensing system having a beverage line extending from a beverage source to a dispense site via an ice bank cooler, said cooler monitoring system comprising:

at least one flow rate sensor for measuring the flow rate of beverage in the beverage line;

at least one energy consumption sensor for monitoring energy consumption of the ice bank cooler; and a controller configured to:

receive an energy consumption signal from the at least one energy consumption sensor and to send an alert signal, via a wireless transmission path, to a remote location separate from the controller when energy consumption increases above a predetermined maximum value;

receive a flow rate signal from the at least one flow rate sensor and control growth of an ice bank of the ice bank cooler in response to the flow rate signal to adjust the cooling of the beverage line; and send beverage throughput and dispense volume data, based on the flow rate signal, to the remote location via a wireless transmission path.

2. A cooler monitoring system according to claim 1 wherein the at least one energy consumption sensor is adapted for monitoring the energy consumption of a compressor within the cooler.

3. A cooler monitoring system according to claim 1 wherein the at least one energy consumption sensor is an amp meter.

4. A cooler monitoring system according to claim 1 wherein the wireless transmission path comprises a mobile phone communications network.

5. A cooler monitoring system according to claim 1, wherein the controller is further configured to receive an over-ride signal from the remote location and to adjust the cooling of the beverage line in response to the over-ride signal.

6. The cooler monitoring system according to claim 1 wherein the controller is mounted on a wall or ceiling of a cellar.

* * * * *